US010633889B2

(12) United States Patent
Tsur et al.

(10) Patent No.: US 10,633,889 B2
(45) Date of Patent: Apr. 28, 2020

(54) CABLE LOCK

(71) Applicant: Michael Mendel Tsur, Jerusalem (IL)

(72) Inventors: Michael Mendel Tsur, Jerusalem (IL); Ido Menashe Tsur, Jerusalem (IL); Noa Tsur, Jerusalem (IL)

( * ) Notice: Subject to any disclaimer, the term of this patent is extended or adjusted under 35 U.S.C. 154(b) by 0 days.

(21) Appl. No.: 16/472,908

(22) PCT Filed: Jun. 6, 2018

(86) PCT No.: PCT/IL2018/050616

§ 371 (c)(1),
(2) Date: Jun. 24, 2019

(87) PCT Pub. No.: WO2018/229748

PCT Pub. Date: Dec. 20, 2018

(65) Prior Publication Data

US 2019/0352931 A1 Nov. 21, 2019

(30) Foreign Application Priority Data

Jun. 15, 2017 (IL) ..... 252954

(51) Int. Cl.
*E05B 45/00* (2006.01)
*H01H 1/06* (2006.01)
(Continued)

(52) U.S. Cl.
CPC ..... *E05B 45/005* (2013.01); *E05B 73/0005* (2013.01); *H01H 1/06* (2013.01);
(Continued)

(58) Field of Classification Search
None
See application file for complete search history.

(56) References Cited

U.S. PATENT DOCUMENTS 3,772,645 A * 11/1973 Odenz ..... B62H 5/003 340/571
3,851,326 A * 11/1974 Costa ..... A45C 13/24 340/571

(Continued)

FOREIGN PATENT DOCUMENTS

| | | |
|---|---|---|
| CA | 1217543 A | 2/1987 |
| CN | 106476936 A | 3/2017 |
| GB | 1435944 A | 5/1976 |

*Primary Examiner* — Chico A Foxx
(74) *Attorney, Agent, or Firm* — Alphapatent Associates, Ltd; Daniel J. Swirsky

(57) ABSTRACT

A cable lock (10), including: a cable (16), for locking an object (26) thereby; a first, being the internal peripheral electric conductor (54B), surrounding the cable (16); a peripheral insulating layer (22), surrounding the first peripheral electric conductor (54B); a second, being the external peripheral electric conductor (54A), surrounding the peripheral insulating layer (22); and an electrical circuit (62), for alerting (56) once any region (58A) of the second peripheral electric conductor (54A) electrically contacts an adjacent region (14A) of the first peripheral electric conductor (54B), by crossing the peripheral insulating layer (22), thereby a blade (28) pressing on the second peripheral electric conductor (54A) induces the electrical contact of the second peripheral electric conductor (54A) with the first peripheral electric conductor (54B), thereby the electrical circuit (62) alerts (56) prior to cutting the cable (16).

7 Claims, 3 Drawing Sheets

(51) Int. Cl.

| | |
|---|---|
| ***H01H 1/14*** | (2006.01) |
| ***H01H 9/02*** | (2006.01) |
| ***E05B 73/00*** | (2006.01) |
| *E05B 71/00* | (2006.01) |

(52) U.S. Cl.
CPC ..... *H01H 1/14* (2013.01); *H01H 9/0271* (2013.01); *E05B 71/00* (2013.01); *H01H 2239/038* (2013.01)

(56) References Cited

U.S. PATENT DOCUMENTS 3,866,205 A * 2/1975 Payne ..... E05B 45/005 340/571
4,340,007 A * 7/1982 Hogan ..... E05B 45/005 116/33
4,379,281 A * 4/1983 Thomas ..... B60R 25/1004 200/61.54
4,663,611 A * 5/1987 Humphrey ..... E05B 45/005 340/426.22
4,992,789 A * 2/1991 Czerwinski ..... G08B 13/06 340/568.2
5,191,314 A * 3/1993 Ackerman ..... B62H 5/20 340/521
5,727,405 A * 3/1998 Cromwell ..... E05B 45/005 340/427
5,767,773 A * 6/1998 Fujiuchi ..... G08B 13/1454 340/571
5,836,002 A * 11/1998 Morstein ..... B60R 25/1001 340/568.1
6,191,685 B1 * 2/2001 Theofanous ..... B62H 5/00 340/432
6,215,400 B1 * 4/2001 Rand ..... G08B 13/1463 340/568.2
9,115,511 B1 * 8/2015 Schmidt ..... E05B 45/005
9,489,808 B1 * 11/2016 Wang ..... G08B 13/00
2003/0201892 A1 * 10/2003 Chance ..... G08B 13/1409 340/568.2
2004/0150524 A1 * 8/2004 Bonato ..... A47F 7/024 340/568.2
2006/0170550 A1 * 8/2006 Marsilio ..... E05B 45/005 340/568.2
2007/0146134 A1 * 6/2007 Belden ..... G08B 13/1445 340/571
2008/0066502 A1 * 3/2008 Sheehan ..... E05B 45/005 70/49
2008/0092599 A1 4/2008 Hazan et al.
2008/0266111 A1 * 10/2008 Shute ..... G09F 3/0358 340/572.9
2008/0316028 A1 * 12/2008 Conti ..... E05B 45/005 340/568.2
2009/0051562 A1 * 2/2009 Potter ..... G08B 21/0286 340/693.5
2010/0315237 A1 * 12/2010 Yang ..... E05B 73/0017 340/572.8
2012/0105230 A1 * 5/2012 Bockstoce ..... G08B 13/1445 340/568.2
2013/0147625 A1 * 6/2013 Sayegh ..... G08B 13/2451 340/568.2
2013/0257404 A1 * 10/2013 McMahon ..... G05F 1/656 323/293
2014/0266729 A1 * 9/2014 Perreau ..... E05B 45/005 340/572.9
2019/0049322 A1 * 2/2019 James ..... G01L 1/146

* cited by examiner

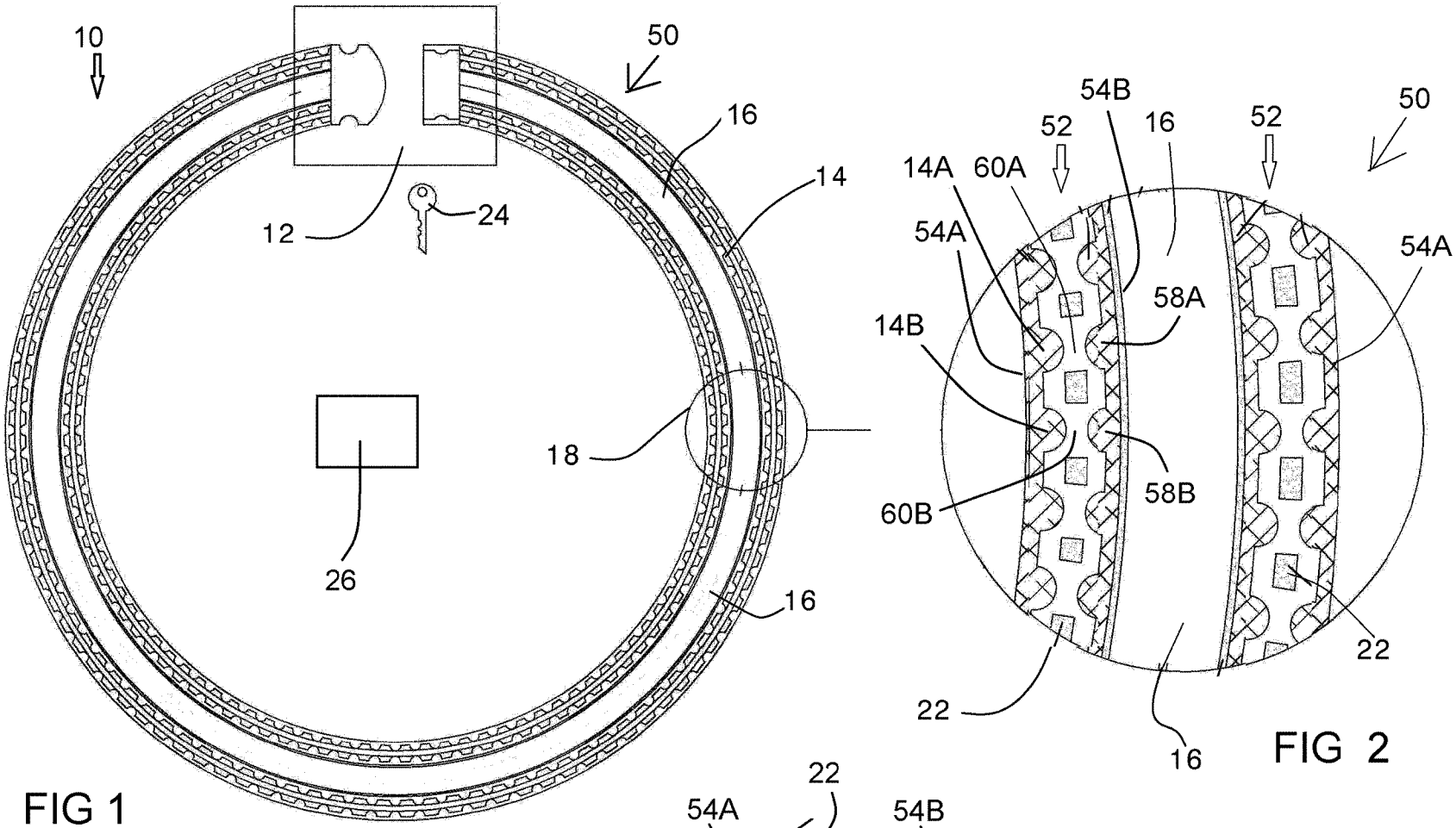
FIG 1
FIG 2
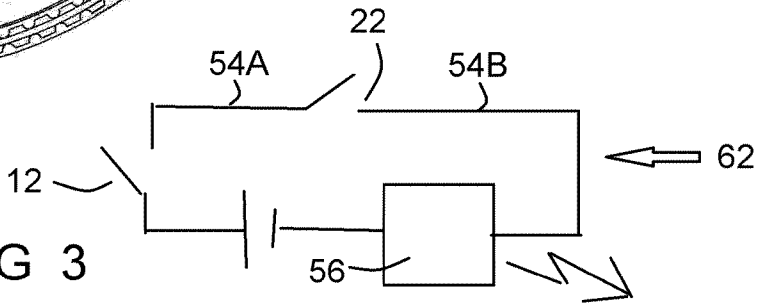
FIG 3

CABLE LOCK

CROSS-REFERENCE TO RELATED APPLICATIONS

This application is a U.S. National Phase Application under 35 U.S.C. 371 of International Application No. PCT/IL2018/050616, which has an international filing date of Jun. 6, 2018, and which claims priority benefit from Israel Patent Application No. 252954, filed Jun. 15, 2017, the disclosure of which is incorporated herein by reference in its entirety.

TECHNICAL FIELD

The invention relates to the field of cable locks, such as for locking bicycles. More particularly, the invention relates to a cable lock for providing an alert.

BACKGROUND

A cable lock, for avoiding theft of bicycles, may further include an alerting function.

There is a long felt need to operate the alerting while the theft operation starts, and not too late.

BRIEF DESCRIPTION OF THE DRAWINGS

FIG. 1 is a top sectional view of a cable lock according to one embodiment of the invention.

FIG. 2 magnifies a certain region of the cable of FIG. 1.

FIG. 3 is an electrical circuit, formed by the electric conducting assembly of FIG. 2.

DETAILED DESCRIPTION

Figure 4:
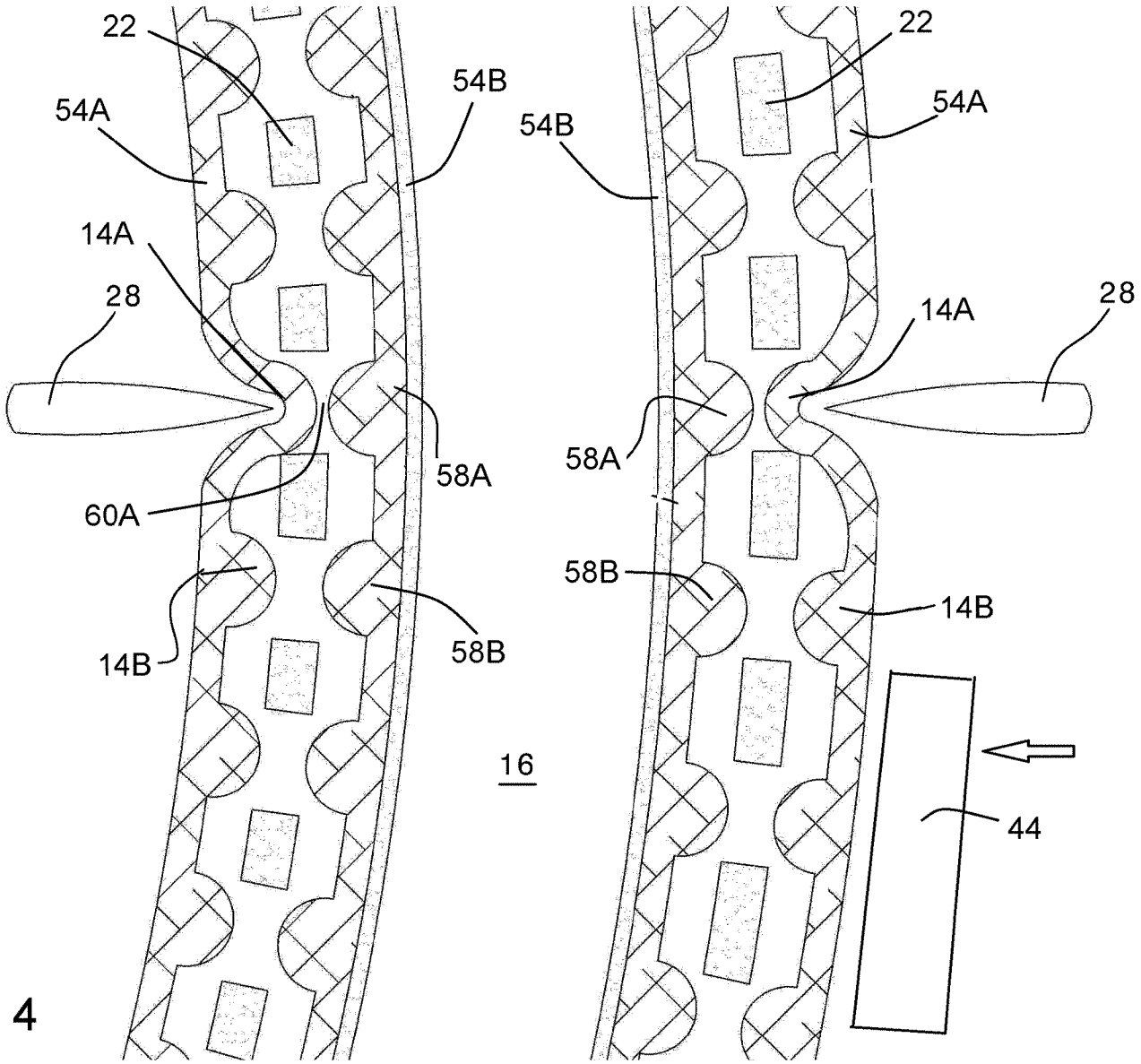
FIG. 4 is the top view of FIG. 2, including a cutting tool of a thief applied on the cable lock of FIG. 2.

FIG. 1 is a top sectional view of a cable lock according to one embodiment of the invention.

A cable lock 10 includes a complex cable 50, ending at it ends with a lock 12, for locking a bicycle 26 or another object.

FIG. 2 magnifies a certain region of the cable of FIG. 1.

Complex cable 50 includes the prior art rigid cable 16, providing the physical protection; and an electric conducting assembly 52, surrounding rigid cable 16.

Electric conducting assembly 52 an internal peripheral electric conductor 54B, surrounding rigid cable 16; an external peripheral electric conductor 54A; and an electric insulating layer 22 in between.

FIG. 3 is an electrical circuit, formed by the electric conducting assembly of FIG. 2.

A transmitter 56 alerts upon a theft attempt event once the electrical circuit 62 is closed, thereby triggers a one-shot electronic element 48, operating transmitter 56, even in case electrical circuit 62 has later been cut.

Thus, electrical circuit 62 is open and the alerting is not executed in case lock 12 and a switch thereof is open. Further the alerting is not executed in the normal case that electric insulating layer 22 insulates, as functioning as a switch, external electric conductor 54A from internal electric conductor 54B.

Referring again to FIG. 2, external electric conductor 54A includes a plurality of protruding regions 14A, 14B, etc.; internal electric conductor 54B includes a plurality of protruding regions 14A, 14B, etc., each for facing one of protruding regions 14A, 14B, etc. of external electric conductor 54A; and electric insulating layer 22 includes a plurality of empty regions 60A, 60B, etc., each for being disposed between one protruding region (such as 14A) of external electric conductor 54A and the facing protruding region (such as 58A) of internal electric conductor 54B.

FIG. 4 is the top view of FIG. 2, including a cutting tool of a thief applied on the cable lock of FIG. 2.

A blade 28 of a cutting tool (of a thief), pressing on external conductor 54A, may press protruding region 14A of external conductor 54A, through empty region 60A of electric insulating layer 22, onto protruding region 58A of internal conductor 54B, thus closes electrical circuit 62 of FIG. 2.

Figure 5:
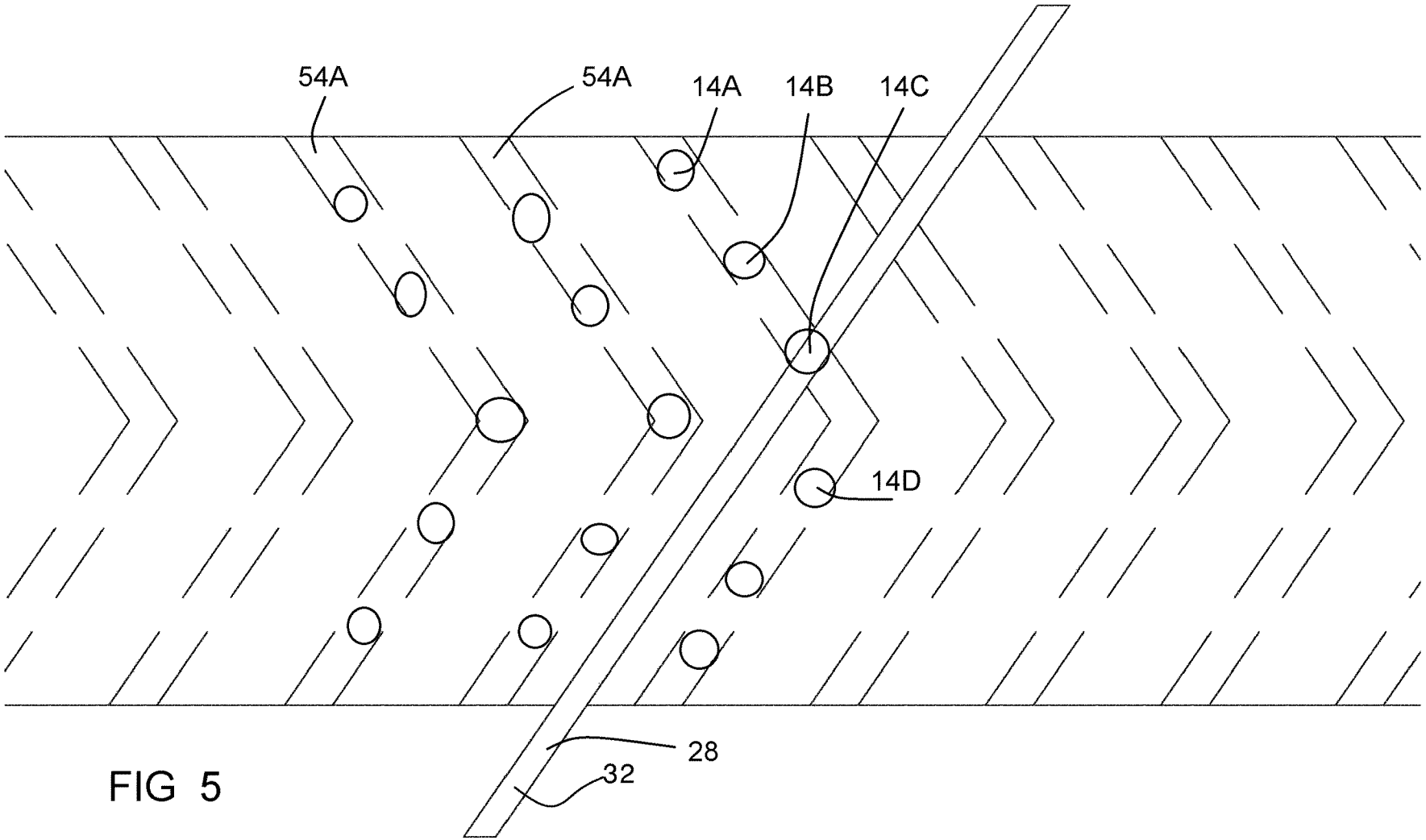
FIG. 5 is the side view of FIG. 4.

FIG. 5 is the side view of FIG. 4.

From the side view, there is no straight line 32 for placing blade 28, which does not include at least one protrusion of protrusions 14A, 14B, 14C, 14D, etc. of external conductor 54A.

Protrusions 14A, 14B, 14C, 14D may be longitudinal, rather than be rounded.

Thus, referring again to FIG. 4, blade 28 of a cutting tool (of a thief), pressing on external conductor 54A, either presses protruding region 14A of external conductor 54A, through empty region 60A of electric insulating layer 22, onto protruding region 58A of internal conductor 54B; or presses protruding region 14B of external conductor 54A, through empty region 60B of electric insulating layer 22, onto protruding region 58B of internal conductor 54B; or presses another protruding region of external conductor 54A, through another empty region of electric insulating layer 22, onto another protruding region of internal conductor 54B.

Even though there is no straight line for placing blade 28, which does not include at least one protrusion of external conductor 54A, insulating layer 22 prevents any electric contact between external conductor 54B and internal conductor 54B if the pressure on external conductor 54B is applied by a broad object 44.

Numeral 10 denotes the cable lock according to one embodiment of the invention;

numerals 14A, 14B, 14C and 14D denote protrusions of the external electric conductor;

numeral 16 denotes the rigid cable;

numeral 22 denotes the electric insulating layer, being normally an open switch, and the switch closes upon applying pressure by a narrow blade;

numeral 24 denotes a key;

numeral 32 denotes a straight line that the thief wishes to go around the external and internal conductors; however there is no such straight line;

numeral 44 denotes an object pressing on the cable lock, being sufficiently broader than the blade of the cutter, thus which should not execute the alerting;

numeral 48 denotes a one-shot electronic element;

numeral 50 denotes the cable;

numeral 52 denotes the electric conducting assembly;

numeral 54A denotes the external electric conductor;

numeral 54B denotes the internal electric conductor;

numeral 56 denotes a transmitter;

numerals 58A and 58B denote protrusions of the internal electric conductor;

numerals 60A and 60B denote empty regions of the insulating layer;

The reference numbers in the claims should not be interpreted as limiting the claims in any form.

What is claimed is:

1. A cable lock (10), comprising:

a cable (16), for locking an object thereby;

a first peripheral electric conductor (54B), surrounding said cable (16);

a peripheral insulating layer (22), surrounding said first peripheral electric conductor (54B);

a second peripheral electric conductor (54A), surrounding said peripheral insulating layer (22); and an electrical circuit (62), for alerting (56) once any region (58A) of said second peripheral electric conductor (54A) electrically contacts an adjacent region (14A) of said first peripheral electric conductor (54B), by crossing said peripheral insulating layer (22), thereby a blade (28), pressing on said second peripheral electric conductor (54A) induces said electrical contact of said second peripheral electric conductor (54A) with said first peripheral electric conductor (54B), for inducing said alerting (56), thereby said alerting, induced by said blade (28) is triggered prior to cutting said cable (16) by said blade (28), whereas another object (44) being broader than said blade (28), pressing on said second peripheral electric conductor (54A) does not induce said alerting (56).

2. A cable lock (10) according to claim 1, wherein said peripheral insulating layer (22) comprises a plurality of empty regions (60A, 60B), for allowing said crossing thereof.

3. A cable lock (10) according to claim 1, wherein said first peripheral electric conductor (54B) comprises a plurality of protruding regions (14A, 14B), each for crossing said peripheral insulating layer (22) upon being pressed by said blade (28).

4. A cable lock (10) according to claim 3, wherein any straight line (32) on said first peripheral electric conductor (54B) comprises at least one (14C) of said plurality of protruding regions (14A, 14B, 14C), thereby said blade (28) must encounter at least one (14C) of said protruding regions.

5. A cable lock (10) according to claim 1, wherein said second peripheral electric conductor (54A) comprises a plurality of protruding regions (60A, 60B), each for facing a protruding region (14A, 14B) of said first peripheral electric conductor (54B).

6. A cable lock (10) according to claim 1, wherein said peripheral insulating layer (22) comprises a plurality of empty regions (60A, 60B), each for facing a protruding region (14A, 14B) of said first peripheral electric conductor (54B), for allowing said crossing thereof.

7. A cable lock (10) according to claim 1, further comprising:

an electronic element (48), for continuing said alerting (56) even in case said electrical circuit (62) has been cut.

* * * * *